US007403087B2

(12) United States Patent
Oh

(10) Patent No.: US 7,403,087 B2
(45) Date of Patent: Jul. 22, 2008

(54) PRESSURE TRIP DEVICE FOR CIRCUIT BREAKER

(75) Inventor: Ki-Hwan Oh, Chungcheongbuk-Do (KR)

(73) Assignee: LS Industrial Systems Co., Ltd., Seoul (KR)

( * ) Notice: Subject to any disclaimer, the term of this patent is extended or adjusted under 35 U.S.C. 154(b) by 77 days.

(21) Appl. No.: 11/235,155

(22) Filed: Sep. 27, 2005

(65) Prior Publication Data

US 2006/0077023 A1 Apr. 13, 2006

(30) Foreign Application Priority Data

Oct. 7, 2004 (KR) ..... 10-2004-0079822

(51) Int. Cl.
*H01H 9/00* (2006.01)

(52) U.S. Cl. ..... 335/172

(58) Field of Classification Search ..... 335/172
See application file for complete search history.

(56) References Cited

U.S. PATENT DOCUMENTS 3,748,418 A * 7/1973 Kawasaki ..... 200/82 B (Continued)

FOREIGN PATENT DOCUMENTS

| | | |
|---|---|---|
| JP | 6185744 | 5/1986 |
| JP | 2119020 | 5/1990 |
| JP | 1196879 | 4/1999 |
| JP | 2000100308 | 4/2000 |
| JP | 200293299 | 3/2002 |

OTHER PUBLICATIONS

English language Abstract of JP 2000-100308.

(Continued)

*Primary Examiner*—Elvin G. Enad
*Assistant Examiner*—Joselito Baisa
(74) *Attorney, Agent, or Firm*—Greenblum & Bernstein, P.L.C.

(57) ABSTRACT

A pressure trip device for a circuit breaker comprises a plurality of single pole switching units, each unit corresponding to each electrical phase hermetically mounting movable contactors and fixed contactors in an insulated case in order to switch electrical circuits according to each phase, having arc gas exhaust port, and connected to one another by a shaft; a switching mechanism connected to one of the single pole switching units for contacting or separating the movable contactor of the connected single pole switching unit to/from the fixed contactor of the connected single pole switching unit; a trip bar connected to the switching mechanism for tripping the switching mechanism; a gas pressure shooter facing the trip bar, and perpendicularly movable between a position for rotating the trip bar by a pressurization and a position separated from the trip bar; and a protrusion wall portion having a pair of wall portions facing to each other and perpendicularly extending from at least one outer surface of each case of the single pole switching units, having one wall portion for connecting lower ends of the pair of wall portions to each other, and forming a gas pressure storing space for supporting the gas pressure shooter to be perpendicularly movable and connected to the arc gas exhaust port. Accordingly, the circuit breaker is tripped faster than the conventional one using a tripping process by mechanisms of multi-step.

9 Claims, 9 Drawing Sheets

U.S. PATENT DOCUMENTS

| | | | | |
|---|---|---|---|---|
| 4,680,564 | A | 7/1987 | DiMarco et al. | |
| 5,103,198 | A * | 4/1992 | Morel et al. | 335/6 |
| 6,225,588 | B1 | 5/2001 | Kaneko | |
| 6,542,057 | B2 * | 4/2003 | Douville et al. | 335/172 |
| 6,787,725 | B2 | 9/2004 | Kim et al. | |
| 6,884,949 | B2 | 4/2005 | Yoon | |

OTHER PUBLICATIONS

English language Abstract of JP 2-119020.
English language Abstract of JP 2000-93299.
English language Abstract of JP 11-96879.

* cited by examiner

PRESSURE TRIP DEVICE FOR CIRCUIT BREAKER

BACKGROUND OF THE INVENTION

1. Field of the Invention

The present invention relates to a circuit breaker, and more particularly, to a pressure trip device for a circuit breaker capable of faster tripping a circuit breaker by using a pressure of arc gas generated when a movable contactor and a fixed contactor are separated from each other by an electromagnetic repulsive force.

2. Description of the Related Art

FIGS. 1 and 2 are respectively a lateral view and a perspective view of a circuit breaker in accordance with the conventional art.

As shown in FIGS. 1 and 2, the conventional circuit breaker constituted with a single pole switching unit 22 comprises an outer case 21 for protecting a mechanism, a magnetic core 25 installed in the outer case 21 for generating an electromagnetic force proportionally to an electrical current flowing on the circuit breaker, an armature 26 attracted by the magnetic core 25, a cross bar 27 actuated by the armature 26, a trip shooter 28 actuated by the cross bar 27, a spring 29 for providing a driving force to the trip shooter 28, and a trip bar 24 being rotated by the trip shooter 28 for triggering the switching mechanism of the circuit breaker to a position of trip.

FIG. 3 is a view showing a locked state of a trip shooter for the circuit breaker of FIG. 1, FIG. 4 is an enlarged view of a part 'A' in FIG. 3, FIG. 5 is a view showing a released state of the trip shooter for the circuit breaker of FIG. 1, and FIG. 6 is an enlarged view of a part 'B' in FIG. 5.

Referring to FIGS. 3 and 4, in the conventional circuit breaker, the trip shooter 28 is locked by the cross bar 27 when a normal current flows, and thus the trip bar 24 maintains a reset position.

Referring to FIGS. 5 and 6, an electromagnetic force of the magnetic core 25 pulls the armature 26 when a large current such as short circuit current is generated.

Upper end of the pulled armature 26 pushes the cross bar 27 to rotate clockwise, thereby releasing a hooked portion 28*a* of the trip shooter 28 locked by a hook 27*a* of the cross bar 27.

The trip shooter 28 is counterclockwise rotated by an elastic force of the spring 29, and rotates the trip bar 24 clockwise. Accordingly, a not shown latch is released by the rotation of the trip bar 24 and the switching mechanism of the circuit breaker is driven to a position of trip by a not shown trip spring.

However, the conventional circuit breaker has the following problems. Since the conventional circuit breaker is tripped by a process using mechanisms of a multi-step, arc energy is drastically increased due to a time delay at the time of an occurrence of an electric shortage current. The drastic arc energy increase damages a body and a mechanic part of the circuit breaker and fuses a movable contactor (not shown) and a fixed contactor (not shown) to each other, thereby degrading a reliability of the circuit breaker.

BRIEF DESCRIPTION OF THE INVENTION

Therefore, an object of the present invention is to provide a pressure trip device for a circuit breaker capable of shortening the time for tripping a circuit breaker at the time of an occurrence of an electric shortage current.

To achieve these and other advantages and in accordance with the purpose of the present invention, as embodied and broadly described herein, there is provided a pressure trip device for a circuit breaker, comprising: a plurality of single pole switching units, each unit corresponding to each electric phase having a movable contactor and fixed contactors in an insulated case in order to switch an electric circuit for each electric phase, an arc gas exhaust port, and connected to one another by a shaft;

a switching mechanism connected to one of the single pole switching units for contacting or separating the movable contactor of the connected single pole switching unit to/from the fixed contactor of the connected single pole switching unit;

a trip bar connected to the main circuit switching unit for tripping the switching mechanism;

a gas pressure shooter facing the trip bar, and perpendicularly movable between a position for rotating the trip bar by pushing and a position separated from the trip bar; and a protrusion wall portion having a pair of wall portions facing to each other and perpendicularly extending from at least one outer surface of each case of the single pole switching units, having one wall portion for connecting lower ends of the pair of wall portions to each other, and forming a gas pressure storing space for supporting the gas pressure shooter to be perpendicularly movable and connected to the arc gas exhaust port.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF INVENTION

Reference will now be made in detail to the preferred embodiments of the present invention, examples of which are illustrated in the accompanying drawings.

Hereinafter, a pressure trip device for a circuit breaker according to a first embodiment of the present invention will be explained in more detail with reference to the attached drawings.

Figure 1:
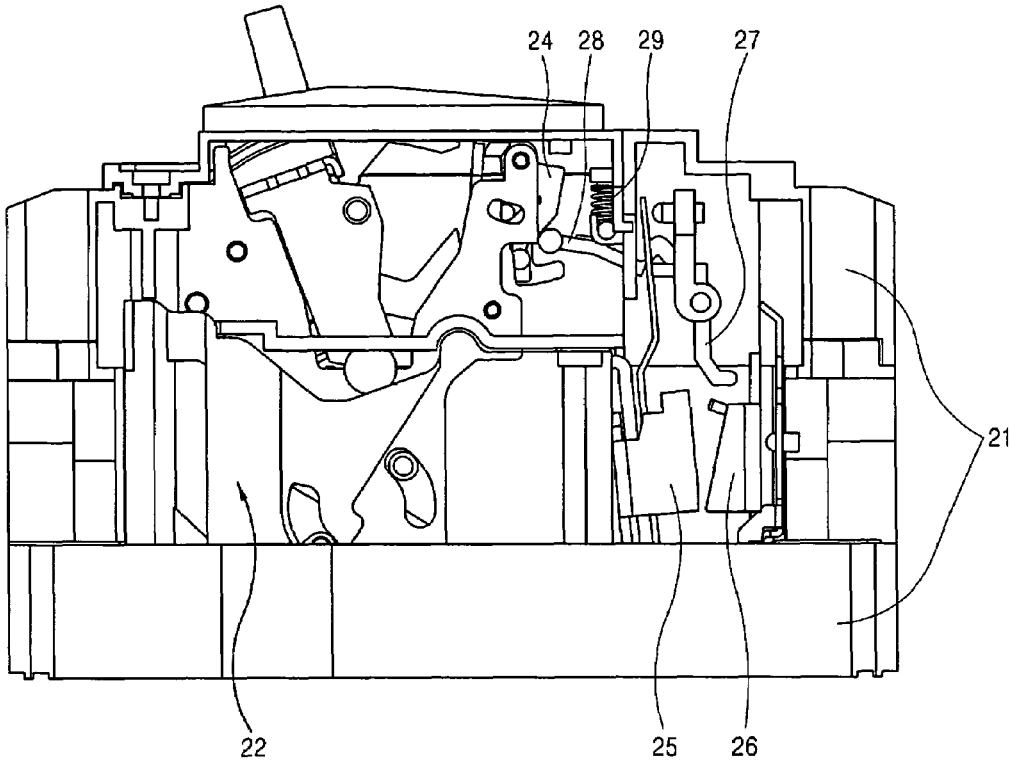
FIG. 1 CONVENTIONAL ART
FIG. 1 is a lateral view showing a circuit breaker in accordance with the conventional art.
Figure 2:
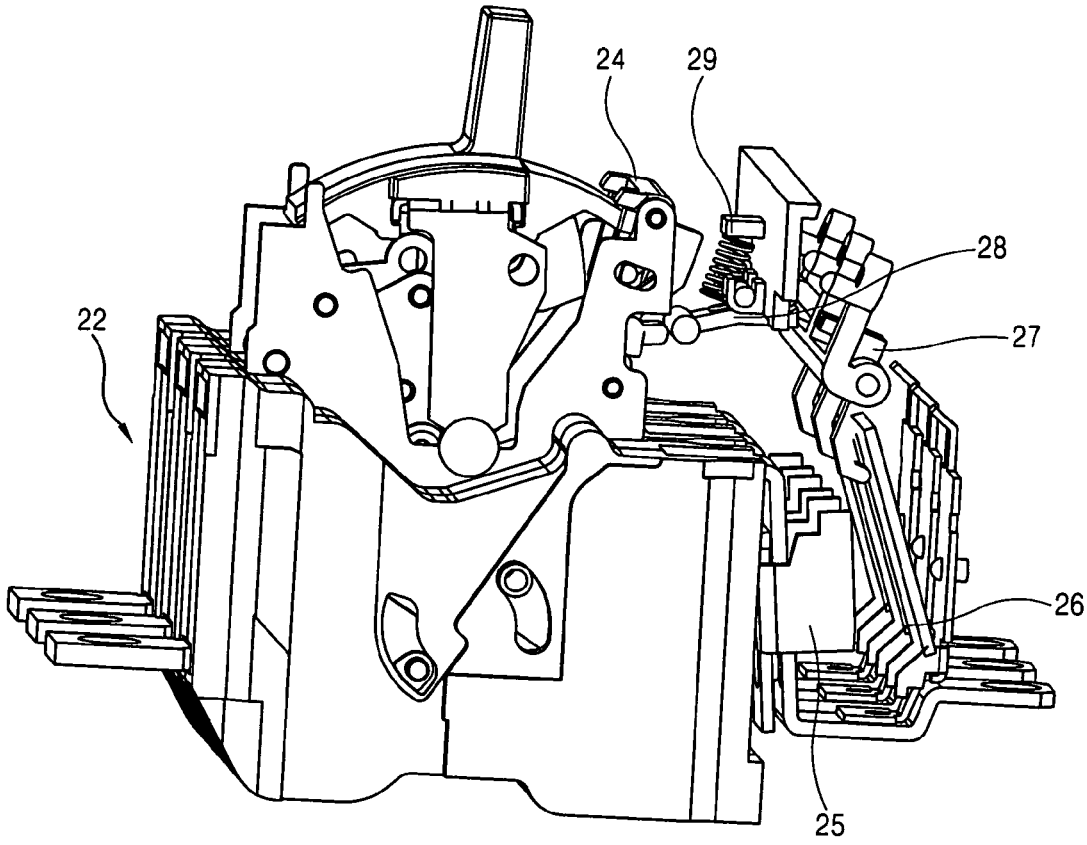
FIG. 2 CONVENTIONAL ART
FIG. 2 is a perspective view showing the circuit breaker of FIG. 1.
Figure 3:
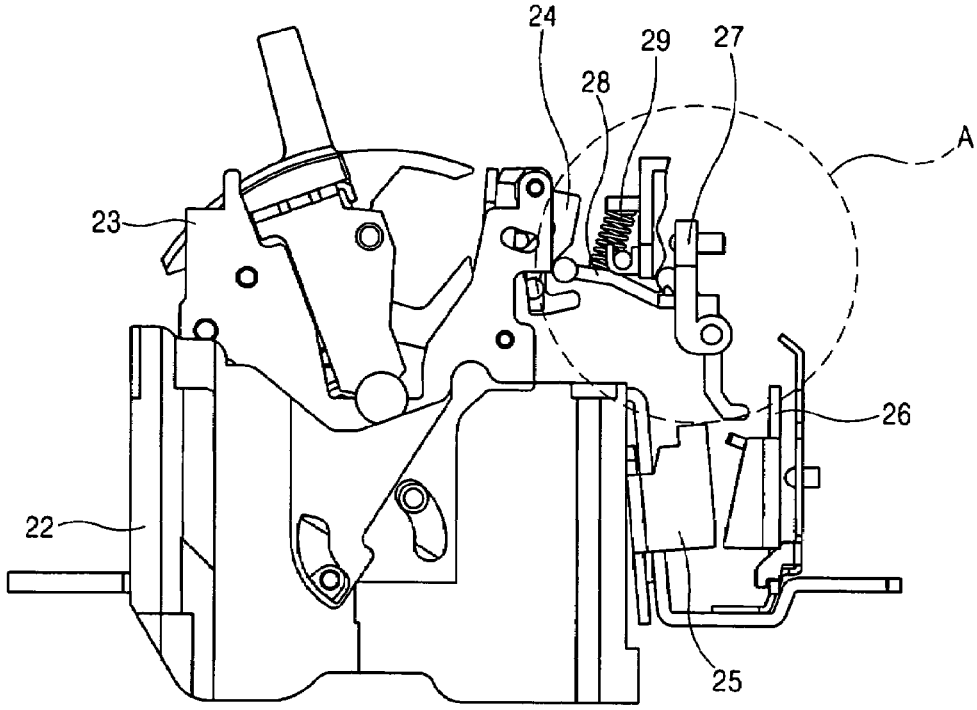
FIG. 3 CONVENTIONAL ART
FIG. 3 is a view showing a locked state of a trip shooter of the circuit breaker of FIG. 1.
Figure 4:
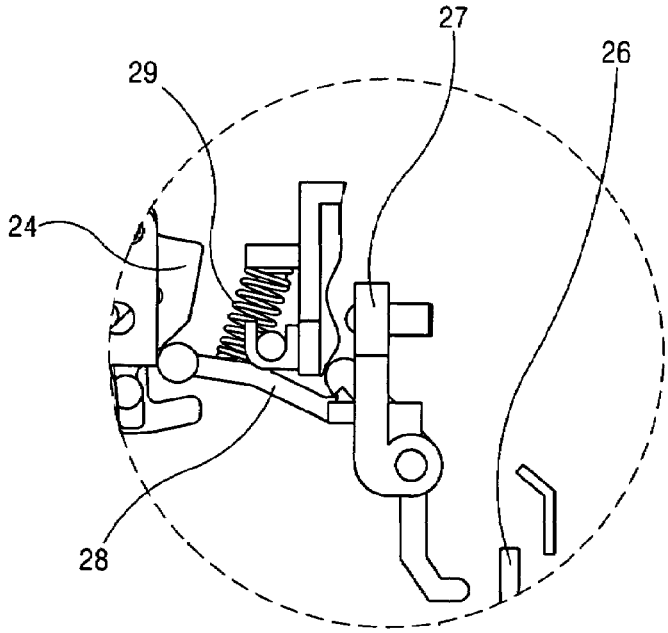
FIG. 4 CONVENTIONAL ART
FIG. 4 is an enlarged view of a part 'A' in FIG. 3.
Figure 5:
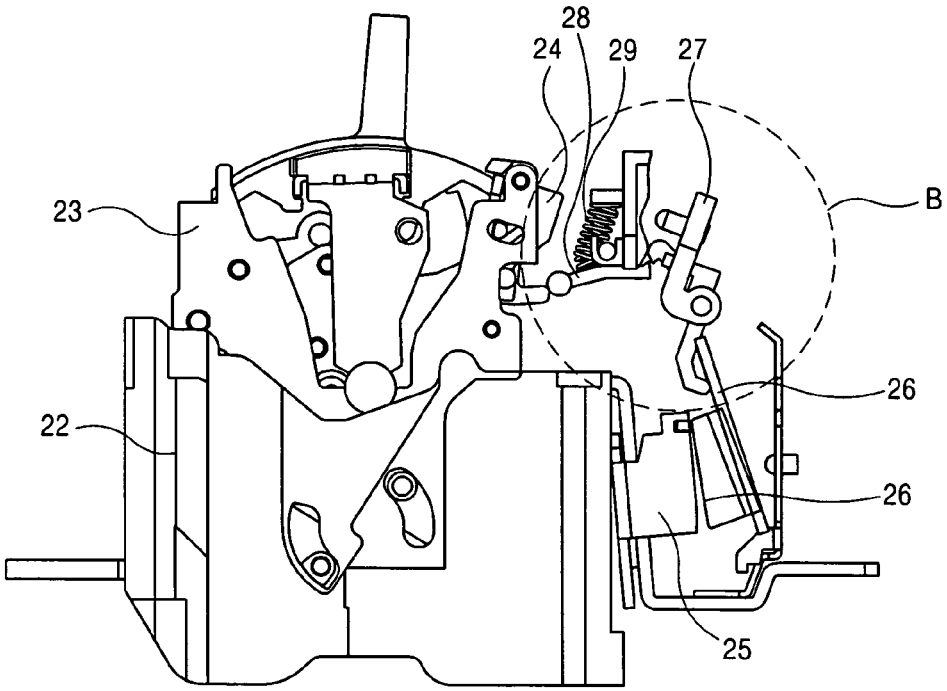
FIG. 5 CONVENTIONAL ART
FIG. 5 is a view showing a released state of the trip shooter of the circuit breaker of FIG. 1.
Figure 6:
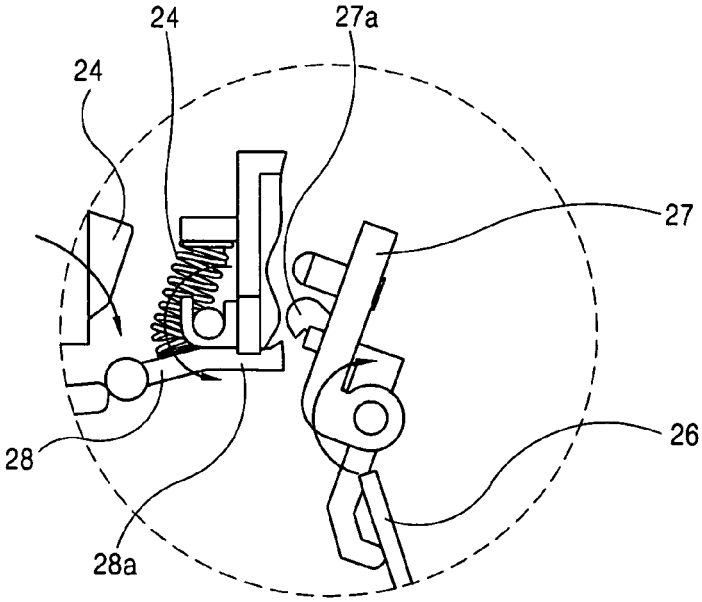
FIG. 6 CONVENTIONAL ART
FIG. 6 is an enlarged view of a part 'B' in FIG. 5.
Figure 7:
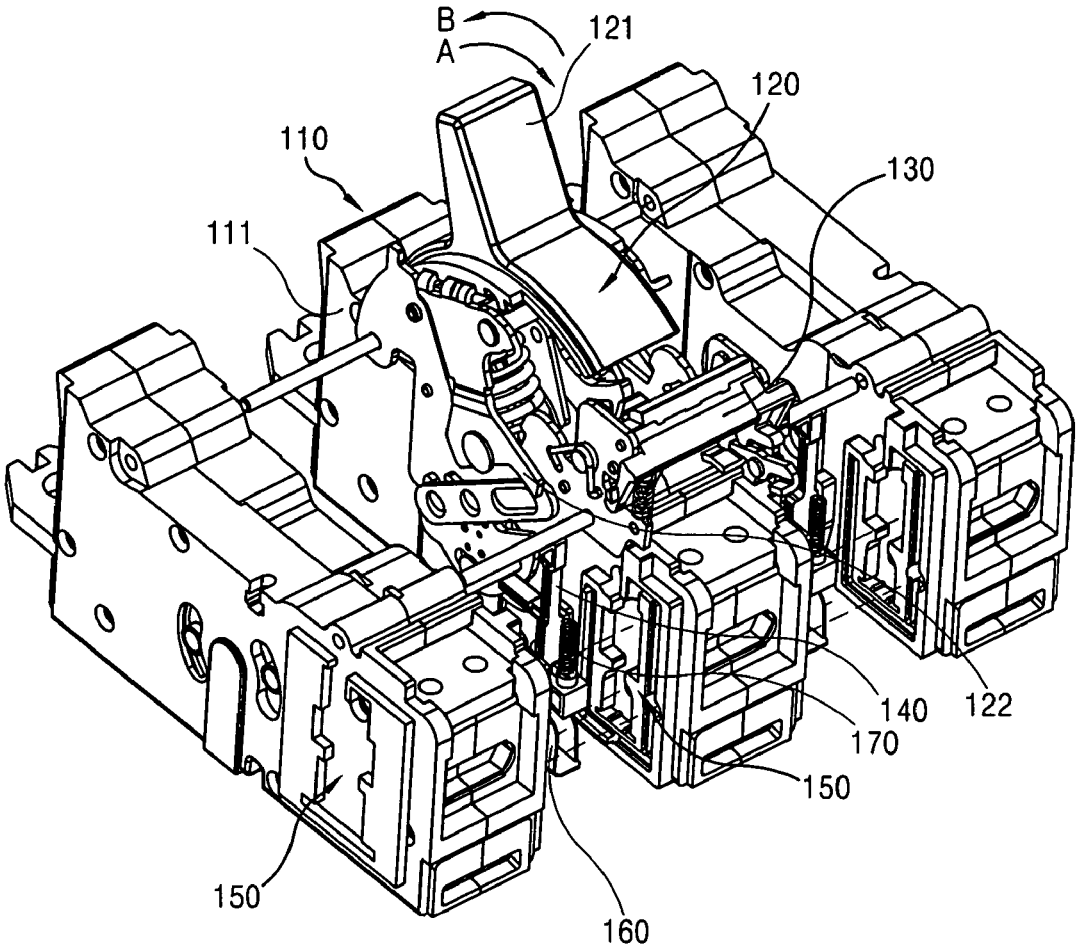
FIG. 7 is a perspective view showing a circuit breaker having a pressure trip device according to a first embodiment of the present invention.
Figure 11:
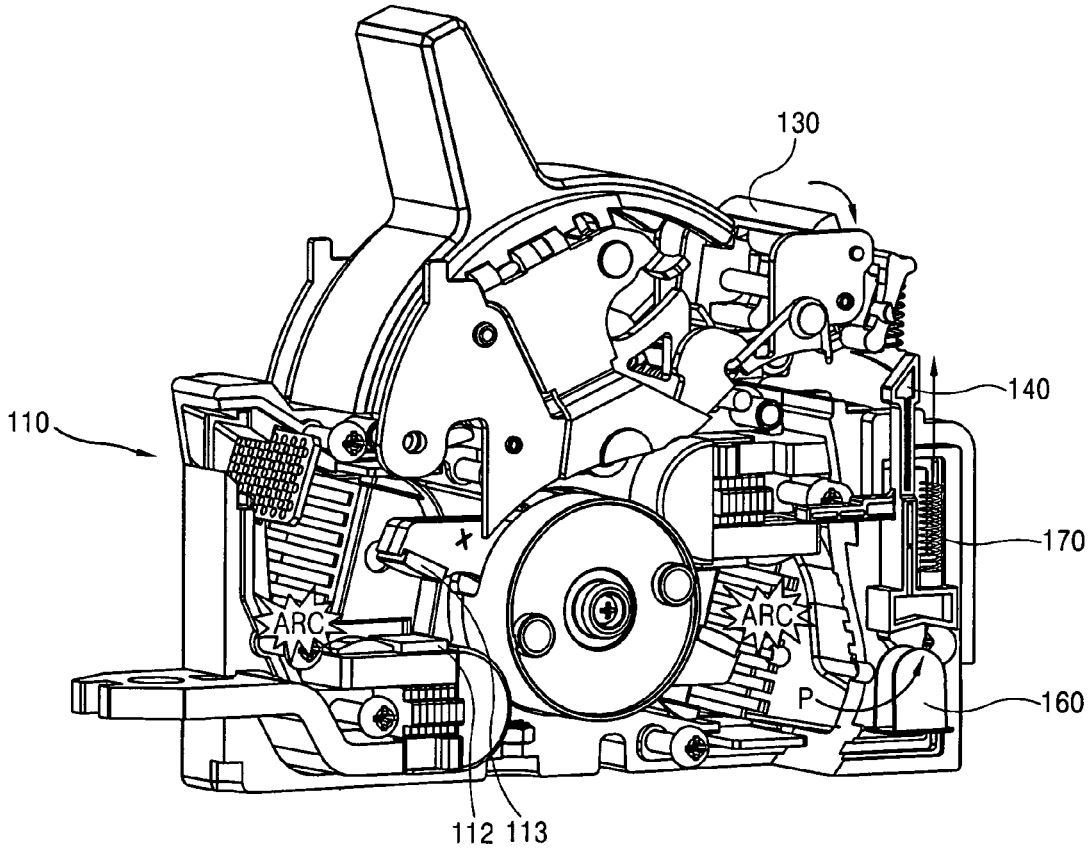
FIGS. 11 to 13 are views showing an operation of the pressure trip device for a circuit breaker according to the present invention.

Referring to FIG. 7, a pressure trip device for a circuit breaker according to a first embodiment of the present invention trips a circuit breaker by using a pressure of arc gas generated between a movable contactor 113 of FIG. 11 and a fixed contactor 112 of the circuit breaker of FIG. 11 when an abnormal current such as an electric shortage current flows on a circuit.

A circuit breaker having the pressure trip device according to the first embodiment of the present invention comprises a plurality of single pole switching units according to each phase 110, a switching mechanism 120, a trip bar 130, a gas pressure shooter 140, a protrusion wall portion 150, an insulating plate 160, and a return spring 170.

When the circuit breaker is for a three-phases Alternating Current (abbreviated as AC), three single pole switching units 110 are provided or four single pole switching units 110 constructed by adding one single pole switching unit for a neutral pole to the three single pole switching units 110 are provided. The single pole switching units 110 are connected to one another for simultaneous driving by a shaft.

The case 111 of the single pole switching unit 110 is provided with the fixed contactor 112 of FIG. 11 and the movable contactor 113 of FIG. 11 for switching electrical circuit corresponding to each phase therein.

Figure 13:
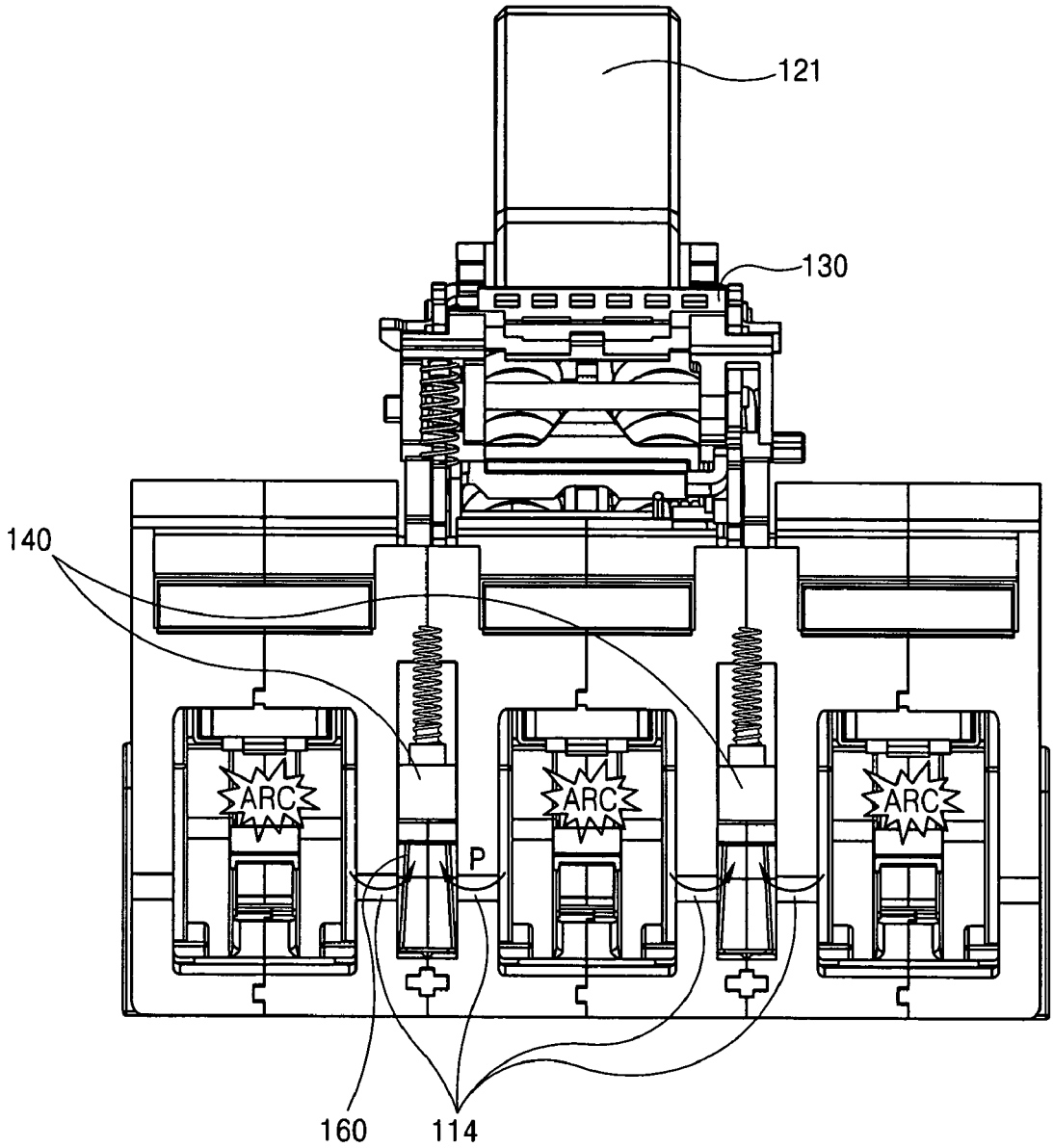

Arc gas exhaust ports 114 of FIG. 13 are provided at a position on an outer surface of the case 111 corresponding to a position on which an arc extinguishing mechanism is located.

The switching mechanism 120 is installed at one of the single pole switching units 110, and drives the movable contactor 113 inside the single pole switching unit 110 to contact or separate to/from the fixed contactor 112. In the preferred embodiment of the present invention, the switching mechanism 120 is installed on the single pole switching unit 110 which is located at a central position of the single pole switching units.

The switching mechanism 120 comprises a handle 121 rotatable in the direction 'A' or 'B' for manually switching a circuit, a trip spring (not shown) having one end connected to the handle 121, a link 122 having an upper portion connected to the handle 121 and a lower portion connected to a shaft for supporting the movable contactor 113, a latch (not shown) connected to a middle shaft of the link 122, a latch holder (not shown) installed inside a rotation track of the trip bar 130 for locking or releasing the latch, etc. The construction of the switching mechanism has been well known, thereby omitting the further detail explanation.

The trip bar 130 is connected to the switching mechanism 120 so that the switching mechanism 120 may trip the circuit breaker. When the trip bar 130 rotates, the latch holder (not shown) is rotated to release the latch (not shown). Then, the link 122 is folded by an elastic restoration force of the spring (not shown), thereby rotating the shaft to lift the movable contactor 113 of FIG. 11. At the same time, the movable contactor 113 is separated from the fixed contactor 112, and thereby the circuit breaker is tripped.

Figure 8:
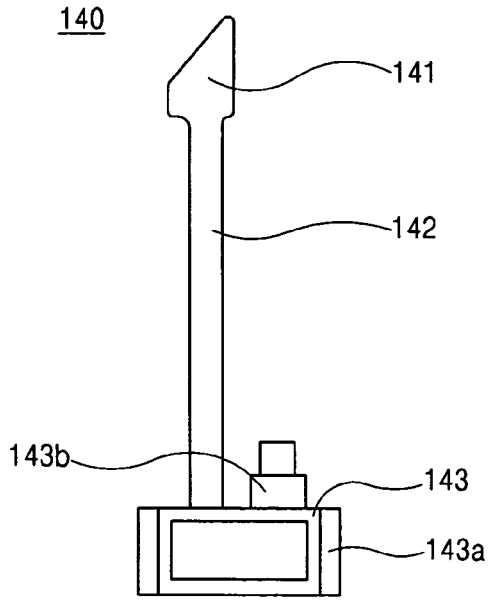
FIG. 8 is a frontal view showing a gas pressure shooter of the pressure trip device of FIG. 7.

Referring to FIGS. 7 and 8, the gas pressure shooter 140 rotates the trip bar 130. The gas pressure shooter 140 includes a leading end portion 141 having an inclined surface directly contacting the trip bar 130, an elongate body portion 142, and a base portion 143 having a width wider than that of the body portion 142 for receiving a pressure P(refer to FIG. 12) of arc gas. The base portion is provided with protrusion portions 143*a* at both side surfaces thereof.

Figure 9:
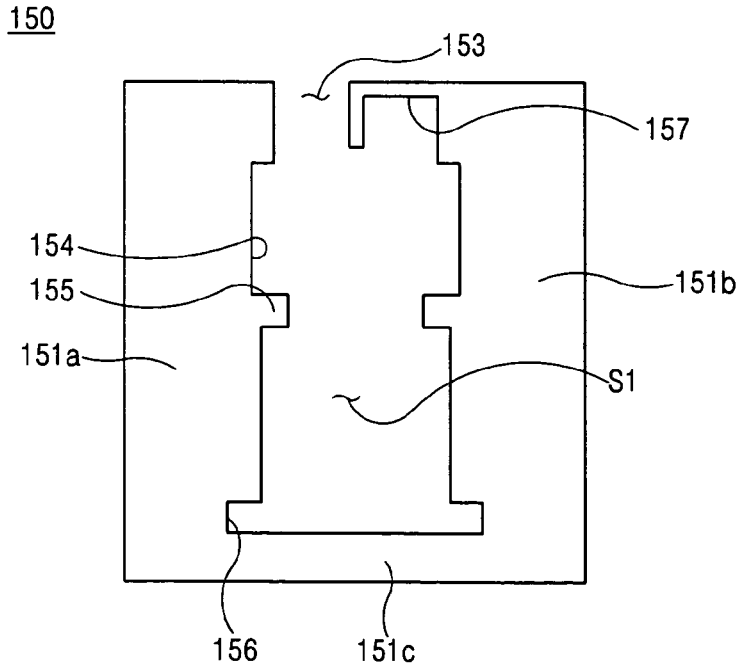
FIG. 9 is a frontal view showing a protrusion wall portion of the pressure trip device of FIG. 7.
Figure 10:
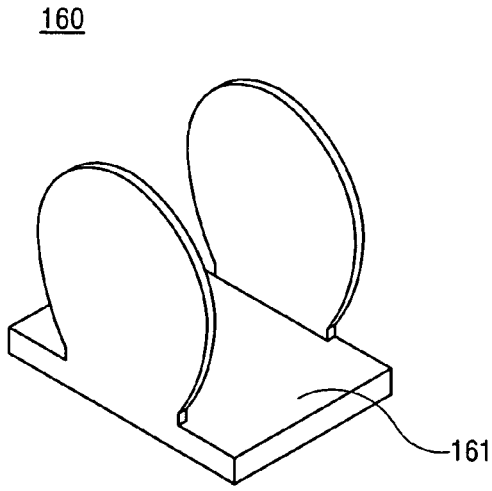
FIG. 10 is a perspective view showing an insulating plate of the pressure trip device of FIG. 7.

Referring to FIGS. 7 and 9, the protrusion wall portion 150 supports the gas pressure shooter 140 to be movable in a perpendicular direction, and forms a gas pressure storing space S1 connected to the arc gas exhaust ports 114 of FIG. 13. The protrusion wall portion 150 includes a left wall portion 151*a*, a right wall portion 151*b*, a lower wall portion 151*c* for connecting the left wall portion 151*a* and the right wall portion 151*b* to each other at the lower ends.

The left wall portion 151*a* of the protrusion wall portion 150 and the right wall portion 151*b* are spaced from each other so that an opening 153 can be formed at an upper end thereof. When the gas pressure shooter 140 moves in a perpendicular direction, the end portion 141 (refer to FIG. 8) and the body portion 142 (refer to FIG. 8) of the gas pressure shooter 140 passes through the opening 153, and thereby the end portion 141 rotates the trip bar 130 of FIG. 11.

The left wall portion 151*a* and the right wall portion 151*b* are respectively provided with a vertical groove wall portion 154 having a limiting protrusion 155. Into the vertical groove wall portion 154, the protrusion portion 143*a* of the base portion of FIG. 8 is inserted to be movable in a perpendicular direction. By the protrusion portion 143*a* inserted into the vertical groove 154, the gas pressure shooter 140 moves perpendicularly within a limited range from a position of pushing the trip bar 130 to a position separated from the trip bar 130.

Referring to FIGS. 7, 9, 10, and 13, when arc gas is exhausted from the arc gas exhaust port 114 of the single pole switching unit 110, the insulating plate 160 prevents the arc gas from moving to the adjacent arc gas exhaust port 114 of the adjacent other single pole switching unit 110 thereby to prevent an occurrence of an electric shortage. The insulating plate 160 is installed between one pair of adjacent single pole shielding units 110 with facing the each arc gas exhaust port 114.

A protrusion having both ends 161 is formed at a lower side of the insulating plate 160. The protrusion having both ends 161 is inserted into a receiving groove 156 formed at the lower side of the left wall portion 151*a* and the right wall portion 151*b*, so insulating plate 160 is supported rotatably by the protrusion wall portion 150.

Figure 12:
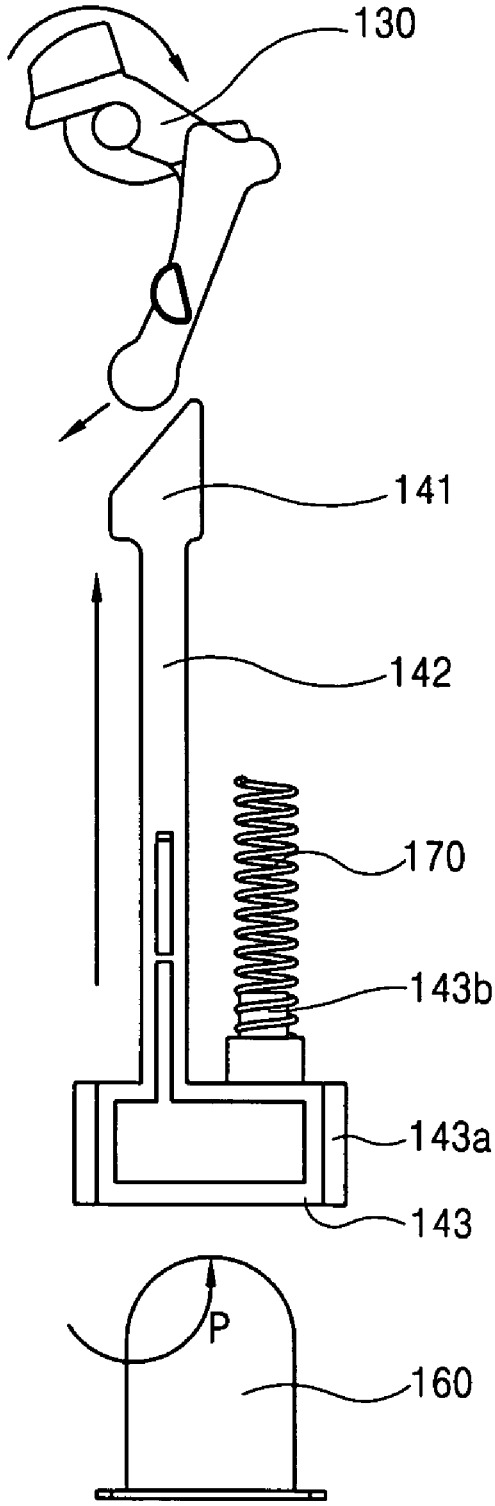

Referring to FIGS. 7 and 12, when the pressure P of arc gas disappears, the return spring 170 expands to return gas pressure shooter 140 to the original position. One end portion of the return spring 170 is supported by a spring supporting protrusion 143*b* upwardly protruded from the base portion 143 of the gas pressure shooter 140, and the other end portion of the return spring 170 is supported by a spring seat portion 157 of FIG. 9 formed at an upper end of the right wall portion 151*b* in the form of a groove.

Hereinafter, an operation of the pressure trip device for a circuit breaker shown in FIGS. 7 to 9 according to a first embodiment of the present invention will be explained.

FIGS. 11 to 13 are views showing an operation of the pressure trip device for a circuit breaker according to the present invention.

Referring to FIG. 11, when an electric shortage current flows on one of three phases, both contacts of the fixed contactor 112 and the movable contactor 113 inside the single pole switching unit 110 are separated from each other by an electromagnetic repulsive force thereby to generate an arc.

Referring to FIG. 13, arc gas generated by the arc pushes the insulating plate 160 towards the arc gas exhaust port 114 of the adjacent single pole switching unit 110 by a pressure P of the arc gas. Then, the arc gas exhaust port 114 of the adjacent single pole shielding unit 110 is blocked by the insulating plate 160, thereby preventing the arc from moving to the adjacent single pole switching unit 110 and thus preventing an occurrence of an electric shortage.

Referring to FIGS. 12 and 13, the arc gas is exhausted to the gas pressure storing space S1 through the arc gas exhaust port 114 of FIG. 9. The exhausted arc gas perpendicularly moves the gas pressure shooter 140 by pressing the lower surface of the base portion 143 of the gas pressure shooter 140 with the pressure P larger than the elastic force of the return spring 170.

The leading end portion 141 of the gas pressure shooter 140 having perpendicularly moved passes through the opening 153 of the protrusion wall portion 150 of FIG. 9 and thus pressurizes one side of the trip bar 130, thereby rotating the trip bar 130 clockwise.

Referring to FIGS. 7 and 11, when the trip bar 130 is rotated, the latch holder (not shown) of the switching mechanism 120 is pushed to release the latch (not shown). Then, the link 122 is folded by an elastic restoration force of the trip spring (not shown), thereby rotating the shaft to lift the movable contactor 113. At the same time, the movable contactor 113 is separated from the fixed contactor 112, and thereby the circuit breaker is tripped.

As aforementioned, in the pressure trip device for a circuit breaker according to the first embodiment of the present invention, the circuit breaker is tripped by the pressure of the arc gas generated when the contacts respectively attached to the movable contactor 113 and the fixed contactor 112 inside the single pole switching unit 110 are separated from each other.

Therefore, the pressure trip device of the present invention can trip the circuit breaker faster than the conventional one using mechanisms of multi-step. Besides, as the arc current can be broken within a short time, thereby to decrease the damage of the switching mechanism and the contacts. Accordingly, the performance of the circuit breaker is enhanced, and the fusion phenomenon generated as the contacts are re-contacted to each other due to the time delay at the time of an occurrence of an electric shortage is prevented.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A pressure trip device for a circuit breaker, comprising:

a plurality of single pole switching units, each unit corresponding to each electric phase having a movable contactor and fixed contactors in an insulated case in order to switch an electric circuit for each electric phase, an arc gas exhaust port, and connected to one another by a shaft;

a switching mechanism connected to one of the single pole switching units that provides contact and separation between the movable contactor of the connected single pole switching unit and the fixed contactor of the connected single pole switching unit;

a trip bar connected to the main circuit switching unit that trips the switching mechanism;

a gas pressure shooter facing the trip bar, and longitudinally movable between a position that rotates the trip bar by pushing and a position separated from the trip bar; and a protrusion wall portion having a pair of wall portions facing each other and perpendicularly extending from at least one outer surface of each case of the single pole switching units, having one wall portion connecting lower ends of the pair of wall portions to each other, and forming a gas pressure storing space that supports the gas pressure shooter to be longitudinally movable and connected to the arc gas exhaust port;

wherein the pair of wall portions of the protrusion wall portion are horizontally spaced from each other a predetermined distance to form an opening at each upper end thereof so that the gas pressure shooter can be longitudinally movable, and are respectively provided with a vertical groove wall portion having a limiting protrusion that limits a movable distance of the gas pressure shooter between a position that rotates the trip bar by a pressurization and a position separated from the trip bar.

2. The device of claim 1, wherein the gas pressure shooter comprises:

a leading end portion having an inclined surface that contacts the trip bar, and rotates the trip bar in one direction;

an elongate body portion longitudinally movable between the pair of wall portions of the protrusion wall portion; and a base portion having a width wider than that of the body portion and that receives a pressure of arc gas.

3. The device of claim 1, wherein the base portion of the gas pressure shooter is provided with protrusion portions at both side surfaces thereof, and the protrusion portions are supported by the vertical grooves formed on the pair of wall portions to be perpendicularly movable.

4. The device of claim 1, further comprising an insulating plate installed between one pair of adjacent single pole switching units facing each arc gas exhaust port and that prevents arc gas generated from the arc gas exhaust port of one single pole switching unit from moving to an adjacent arc gas exhaust port of an adjacent single pole switching unit.

5. The device of claim 4, wherein the insulating plate is provided with a protrusion having both ends at a lower side thereof, and the protrusion having both ends is inserted into a receiving groove formed at a lower side of a left wall portion and a right wall portion of the protrusion wall portion.

6. The device of claim 1, further comprising a return spring installed between the protrusion wall portion and the gas pressure shooter that returns the gas pressure shooter to a position separated from the trip bar when the pressure of arc gas disappears.

7. The device of claim 6, wherein one end of the return spring is supported by a spring supporting protrusion upwardly protruded from the base portion of the gas pressure shooter, and the other end of the return spring is supported by a spring seat portion formed at an upper end of the one protrusion wall portion as a groove shape.

8. A pressure trip device for a circuit breaker, comprising:

a plurality of single pole switching units, each unit corresponding to each electric phase having a movable contactor and fixed contactors in an insulated case in order to switch an electric circuit for each electric phase, an arc gas exhaust port, and connected to one another by a shaft;

a switching mechanism connected to one of the single pole switching units that provides contact and separation between the movable contactor of the connected single pole switching unit and the fixed contactor of the connected single pole switching unit;

a trip bar connected to the main circuit switching unit that trips the switching mechanism;

a gas pressure shooter facing the trip bar, and longitudinally movable between a position that rotates the trip bar by pushing and a position separated from the trip bar;

a protrusion wall portion having a pair of wall portions facing each other and perpendicularly extending from at least one outer surface of each case of the single pole switching units, having one wall portion connecting lower ends of the pair of wall portions to each other, and forming a gas pressure storing space that supports the gas pressure shooter to be longitudinally movable and connected to the arc gas exhaust port; and an insulating plate installed between one pair of adjacent single pole switching units facing each arc gas exhaust port and that prevents arc gas generated from the arc gas exhaust port of one single pole switching unit from moving to an adjacent arc gas exhaust port of an adjacent single pole switching unit;

wherein the insulating plate is provided with a protrusion having both ends at a lower side thereof, and the protrusion having both ends is inserted into a receiving groove formed at a lower side of a left wall portion and a right wall portion of the protrusion wall portion.

9. A pressure trip device for a circuit breaker, comprising:

a plurality of single pole switching units, each unit corresponding to each electric phase having a movable contactor and fixed contactors in an insulated case in order to switch an electric circuit for each electric phase, an arc gas exhaust port, and connected to one another by a shaft;

a switching mechanism connected to one of the single pole switching units that provides contact and separation between the movable contactor of the connected single pole switching unit and the fixed contactor of the connected single pole switching unit;

a trip bar connected to the main circuit switching unit that trips the switching mechanism;

a gas pressure shooter facing the trip bar, and longitudinally movable between a position that rotates the trip bar by pushing and a position separated from the trip bar;

a protrusion wall portion having a pair of wall portions facing each other and perpendicularly extending from at least one outer surface of each case of the single pole switching units, having one wall portion connecting lower ends of the pair of wall portions to each other, and forming a gas pressure storing space that supports the gas pressure shooter to be longitudinally movable and connected to the arc gas exhaust port; and a return spring installed between the protrusion wall portion and the gas pressure shooter that returns the gas pressure shooter to a position separated from the trip bar when the pressure of arc gas disappears;

wherein one end of the return spring is supported by a spring supporting protrusion upwardly protruded from the base portion of the gas pressure shooter, and the other end of the return spring is supported by a spring seat portion formed at an upper end of the one protrusion wall portion as a groove shape.

* * * * *